US007846854B2

(12) United States Patent
Thoral-Pierre et al.

(10) Patent No.: US 7,846,854 B2
(45) Date of Patent: Dec. 7, 2010

(54) BALLISTIC SAFETY DEVICE

(75) Inventors: Karine Thoral-Pierre, Neung sur Beuvron (FR); Benoit Clement, St Jean le Blanc (FR)

(73) Assignee: TDA Armements SAS, La Ferte Saint Aubin (FR)

( * ) Notice: Subject to any disclaimer, the term of this patent is extended or adjusted under 35 U.S.C. 154(b) by 0 days.

(21) Appl. No.: 12/275,788

(22) Filed: Nov. 21, 2008

(65) Prior Publication Data

US 2009/0155523 A1 Jun. 18, 2009

(30) Foreign Application Priority Data

Nov. 23, 2007 (FR) ..... 07 08220

(51) Int. Cl.
*B32B 27/04* (2006.01)

(52) U.S. Cl. ..... 442/135; 2/2.5; 89/36.01

(58) Field of Classification Search ..... 442/134, 442/135, 164, 169, 172, 179, 180, 181, 208, 442/209, 239, 243, 244, 246; 428/911; 89/36.01, 89/36.02, 36.05; 2/2.5
See application file for complete search history.

(56) References Cited

U.S. PATENT DOCUMENTS

| | | | |
|---|---|---|---|
| 6,107,220 | A | 8/2000 | Popper et al. |
| 2003/0228815 | A1 | 12/2003 | Bhatnagar et al. |
| 2009/0090265 | A1 | 4/2009 | Salignon et al. |

FOREIGN PATENT DOCUMENTS

| | | | |
|---|---|---|---|
| EP | 0122857 | A | 10/1984 |
| GB | 2250470 | A | 6/1992 |
| GB | 2253589 | A | 9/1992 |
| WO | WO-94/09336 | A | 4/1994 |

*Primary Examiner*—Arti Singh-Pandey
(74) *Attorney, Agent, or Firm*—Stroock & Stroock & Lavan LLP

(57) ABSTRACT

The present invention relates to a ballistic protection device. A device embodying the invention includes at least three layers of synthetic fabrics forming the reinforcements of one and the same piece obtained by resin-transfer molding, the middle layer made from a fabric including glass fibers crossed with carbon fibers. An embodiment of the invention applies, for example, to the protection of vehicles against ballistic-type attacks.

16 Claims, 5 Drawing Sheets

BALLISTIC SAFETY DEVICE

Figure 1A:
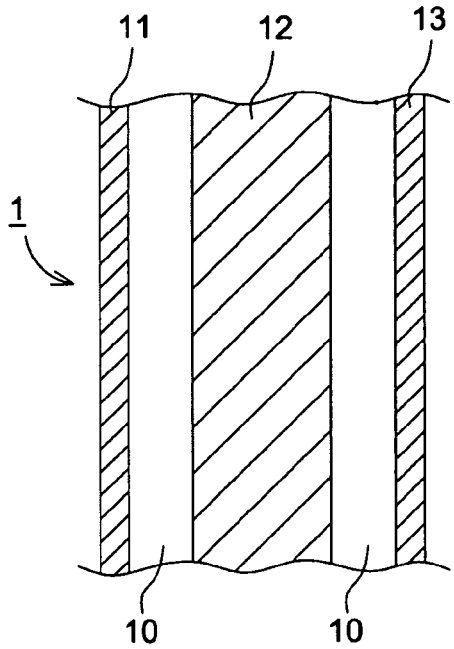

The present application claims the benefit of French Patent Application Serial No. 07 08220, filed Nov. 23, 2007 which is hereby incorporated by reference in its entirety.

The present invention relates to a ballistic protection device. It applies, for example, to the protection of vehicles or people against ballistic-type attacks.

Various types of structures, equipment or people use ballistic protection devices. As an example, light vehicles required to move around in hostile territory, on reconnaissance missions for example, are fitted with ballistic protection.

The primary aim of these devices is to provide effective protection against ballistic attacks, notably perforating projectiles. To this end, they notably comprise one or more layers of steels generally associated with layers of ceramic, all these layers being fixed together by seals of glue or by screwed studs. These assemblies thus form shield panels capable of withstanding perforating projectiles of more or less large size and of very high kinetic energy.

These panels present a number of drawbacks. A first drawback is associated with their weight and their low handlability. In particular, the materials that form these panels and their necessary thicknesses give the whole a significant weight coupled with a lack of flexibility of use.

A second drawback lies in the lack of adaptation of these devices to more or less complex shapes. The protective panels used do not lend themselves to all kinds of shapes. For practical reasons, the dimensions of the panels cannot drop below a certain surface area, which limits the possible shapes, in particular rounded shapes are excluded.

Another drawback stems notably from the projecting angles or sharp edges that can be a feature of these shapes made up of flat panels. In particular, these projecting angles or sharp edges are easily identified by radar systems.

One aim of the invention is notably to overcome the above-mentioned drawbacks. To this end, the subject of the invention is a protection device against ballistic projectiles, including at least three layers of synthetic fabrics forming the reinforcements of one and the same piece obtained by resin-transfer molding.

In the first layer, the fabric consists, for example, of fibers woven in two dimensions, the warp and the weft forming between them an angle of less than or equal to 90°.

In a particular embodiment, the first layer, oriented towards the projectiles, includes aramid fiber fabric.

The middle layer includes fabric including glass fibers crossed with carbon fibers.

The middle layer is, for example, woven in three dimensions, the glass fibers and the carbon fibers being woven in two dimensions, the glass fibers being oriented in a first direction and the carbon fibers being oriented in a second direction.

The two directions can cross at an angle of less than or equal to 90°, for example between 3020 and 60°.

These woven reinforcements, superimposed in pairs, are linked together to provide a cohesion in the third direction.

The third layer consists, for example, of fabric reinforcements linked in pairs by the weaving method in the third direction.

A set of two woven reinforcements linked in pairs comprises a first reinforcement of carbon fibers linked to the second of aramid fibers.

The fabric of the third layer comprises, for example, a finer mesh than that of the other layers.

Each layer comprises a stack of fabric layers, the number of fabric layers depending on the desired thickness.

In a particular embodiment, the thickness of the third layer is half the thickness of the middle layer.

Advantageously, the resin can be a phenolic resin.

The proportion of resin is, for example, 30% and the proportion of fabrics is 70%.

Figure 1B:
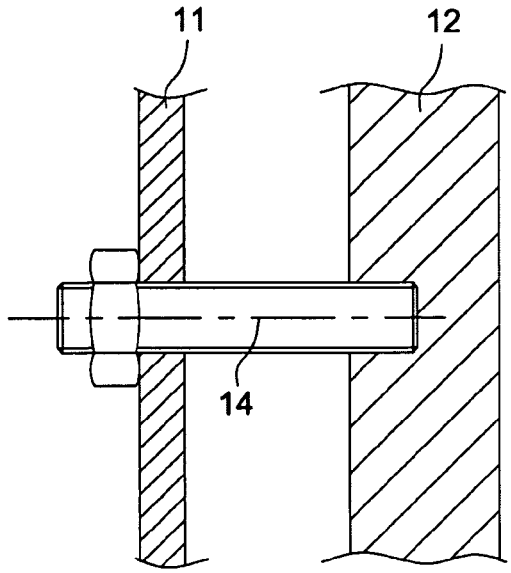
Figure 2:
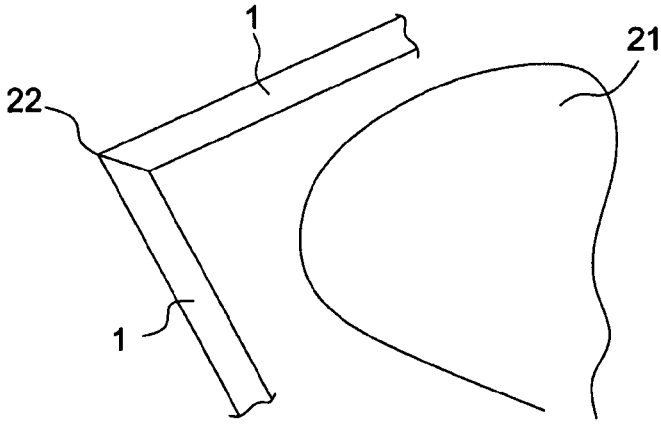
Figure 3:
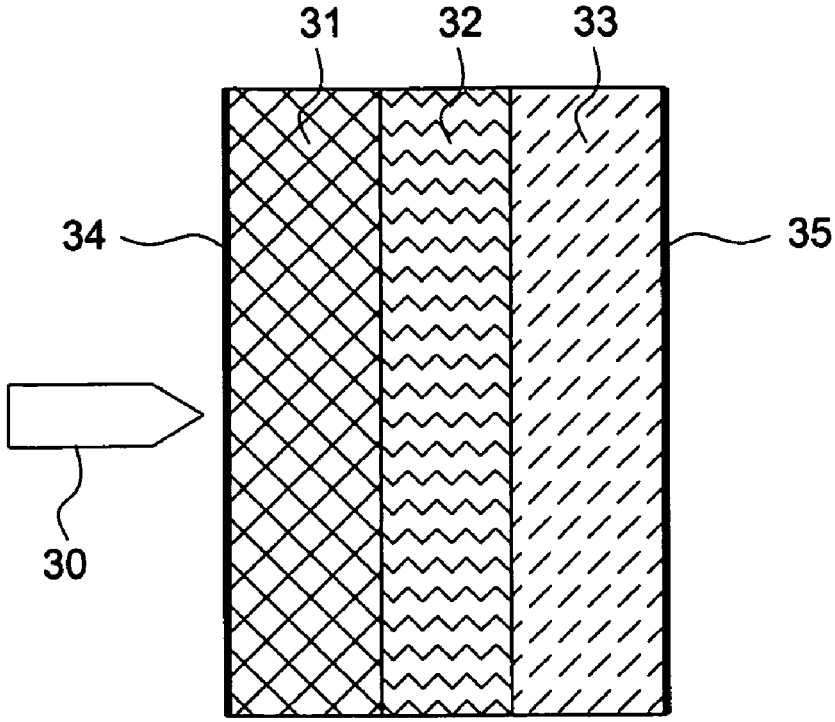
Figure 4B:
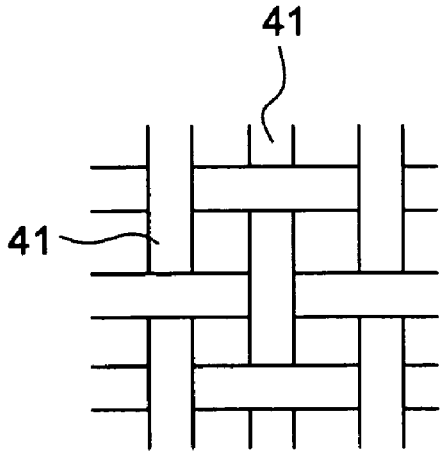
Figure 4A:
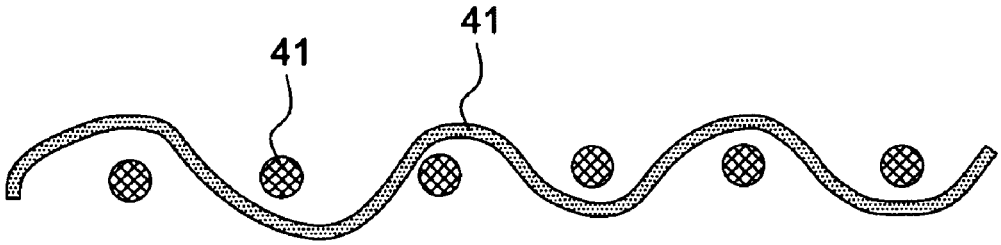
Figure 5A:
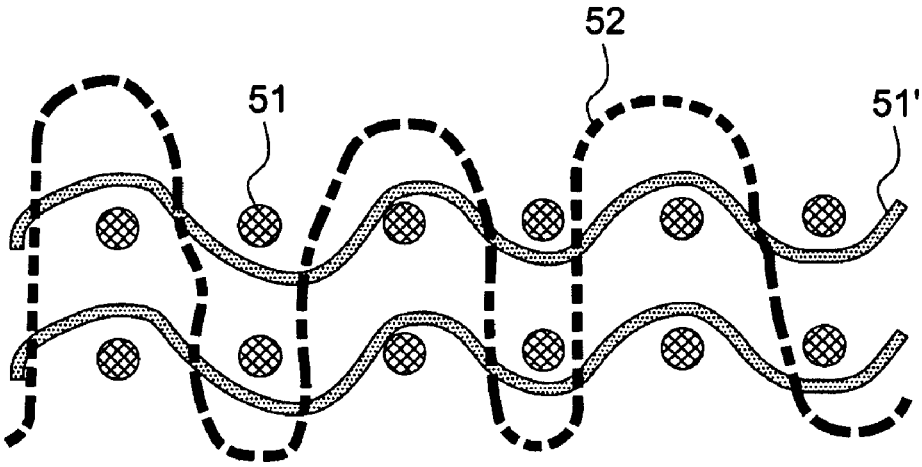
Figure 5C:
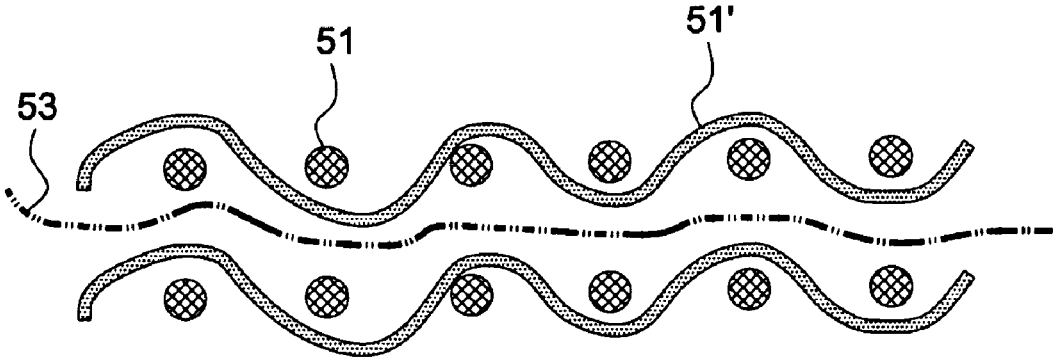
Figure 5B:
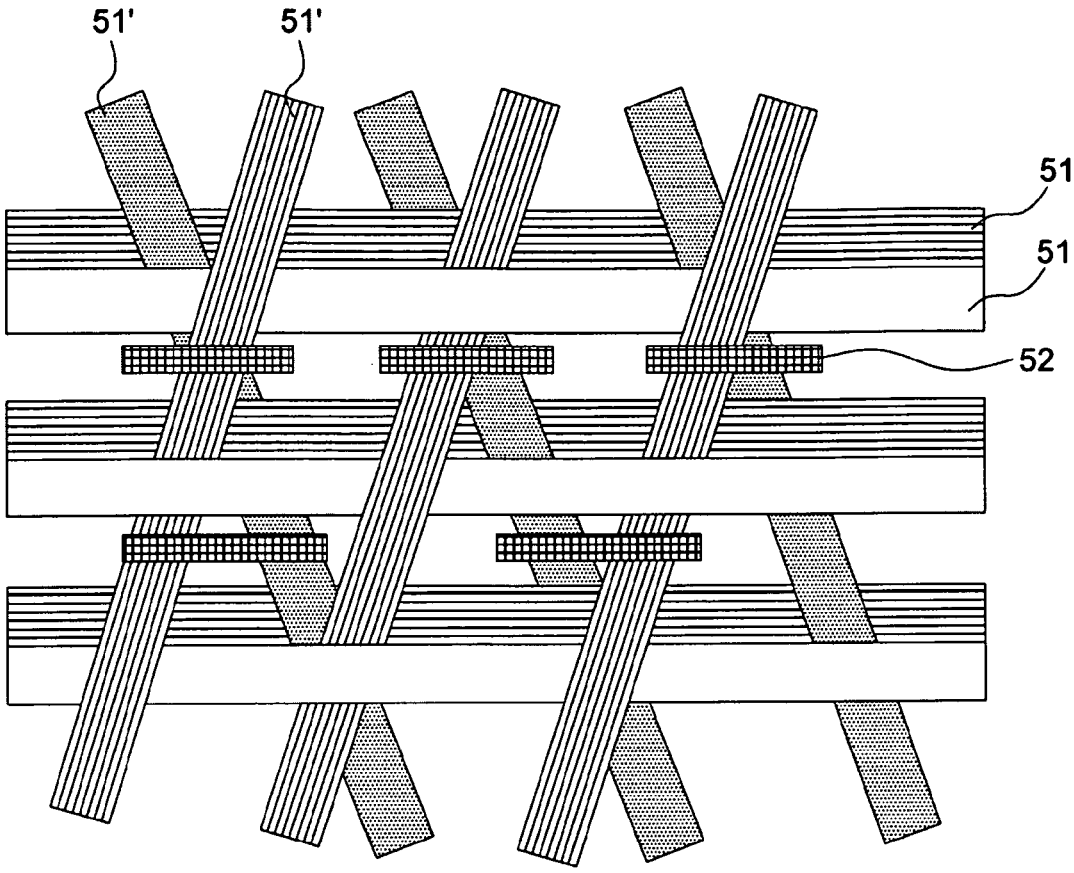
Figure 6:
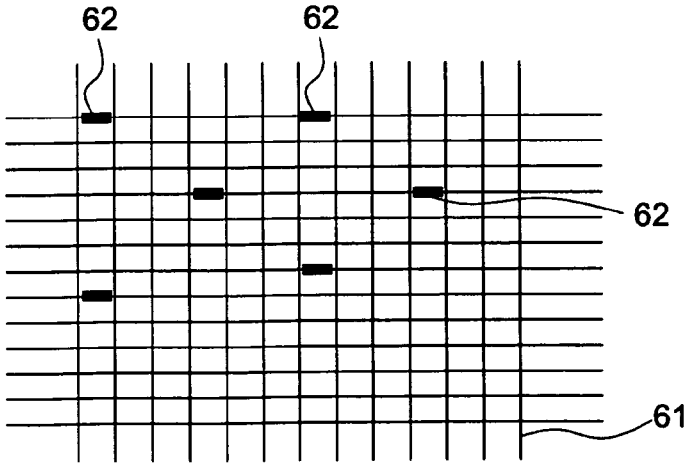
Figure 7:
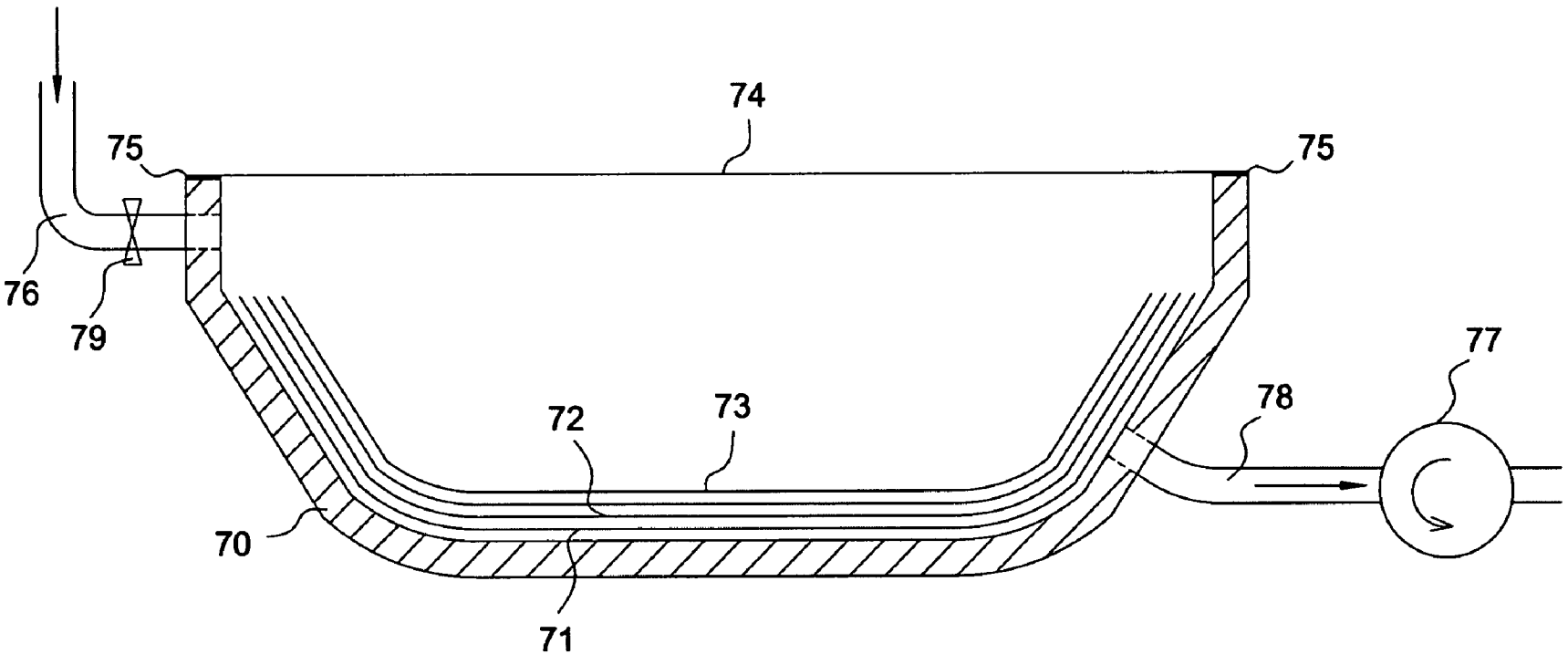

Other characteristics and advantages of the invention will become apparent from the description that follows given in light of the appended drawings which represent:

FIGS. 1*a* and 1*b*, examples of ballistic protection panels according to the prior art;

FIG. 2, an example of panel assembly of the type of FIG. 1 to form a protective structure;

FIG. 3, a possible exemplary embodiment of a protective device according to the invention;

FIGS. 4*a* and 4*b*, an illustration of the principle of production of a two-dimensional weave;

FIGS. 5*a*, 5*b* and 5*c*, an illustration of the principles of production of a three-dimension weave;

FIG. 6, a possible example of weave to form a final layer of a device according to the invention;

FIG. 7, an illustration of a method of producing a device according to the invention.

FIGS. 1*a* and 1*b* present an example of a ballistic protection panel 1 according to the prior art. This panel comprises several layers 11, 12, 13 that are juxtaposed, fixed together by contiguous layers of glue 10 or threaded studs 14. The outer layer is, for example, made of a ceramic-type material whereas the central layer 12 is made of steel, and the layer 13 of composite-type material. Depending on the thickness, notably of this central layer 12, the panel is more or less heavy. In all the possible applications, its weight is an obstacle.

The layers 11, 12 can, moreover, when struck by a ballistic projectile, produce rear effects such as flying splinters. These effects are generally prejudicial, even dangerous, to the environment, in particular for people.

FIG. 2 presents an assembly of panels 1 of the type of that of FIG. 1 for an application to an item of equipment 21. The assembly produced follows, as far as possible, the shape of this equipment 21, but not optimally.

The two panels are linked together at their edges, forming an angle 22 that projects because of the contour adopted. This angle can make it easy to detect the assembly by radar systems, notably by increasing the equivalent radar surface area.

FIG. 3 presents a possible exemplary embodiment of a protection device according to the invention. The device is represented by a partial cross-sectional view. The part represented is flat, but it can advantageously take all kinds of other shapes. The panel of FIG. 3 is formed by a single-piece composite material including three joined layers 31, 32, 33 produced in one and the same mold.

The first layer 31 is arranged on the side of the threat, in this case the arrival of a ballistic projectile 30. It consists, for example, of aramid fibers embedded in the resin. The fibers are previously woven dry in a two-dimensional weave. The dry fabric forms the reinforcement of the layer 31, several layers of fabrics being needed to obtain the desired thickness for the layer 31 obtained by resin-transfer molding, as will be described hereinafter.

FIGS. 4*a* and 4*b* illustrate the principle of production of a two-dimensional weave, respectively by a cross-sectional view and by a plan view. Conventionally, the meshes cross in the two dimensions, that is to say, in one plane, forming a regular reinforcement. FIG. 4*b* shows an example where the threads of the weft and the warp cross perpendicularly. It is possible to provide for a weave in which the threads cross at an angle other than 90°, for example at an angle between 30° and 60°.

The first layer 31 has, for example, a thickness of the order of 1 to 1.5 millimeters. The number of reinforcements superimposed to obtain the desired thickness can be determined beforehand.

This first layer calibrates the penetration diameter to the minimum, it reduces the depth of penetration. Moreover, it prevents the abovementioned rear effects.

The second layer 32 includes glass fibers and carbon fibers fixed in the matrix. These fibers are previously woven dry, in a three-dimensional weave for example. This dry fabric forms the reinforcement of the layer 32.

FIGS. 5*a*, 5*b* and 5*c* illustrate the principle of production of a three-dimensional weave. This weave comprises a first reinforcement of fibers 51 and 51' in a flat weave, in two dimensions, of the type of that of FIGS. 4*a* and 4*b*. In the case of the second layer 32, this reinforcement consists, for example, of glass fibers 51 in one direction and carbon fibers 51' in the other direction. As for the weave of the first layer, these two directions can be oriented at an angle of less than or equal to 90°, for example between 30° and 90°.

Onto this first reinforcement is superimposed a second reinforcement identical to the first, positioned in mirror symmetry relative to the first.

The cohesion of the two reinforcements in the third direction is obtained either by stitching with threads 52, or by a film of glue 53. This second layer has a predominant role in as much as it breaks the projectile or blocks it, and dissipates the energy due to the impact. The size of the meshes of the weave is notably adapted to the diameter of the projectiles. With regard to the thickness, it is also adapted to the type of projectile and notably its penetrating power. A thickness of the order of 50 to 80 millimeters may be necessary. The necessary woven reinforcements are stacked in sufficient numbers to obtain the desired thickness.

The third layer 33 consists, for example, of woven reinforcements linked in pairs in the weaving method, these reinforcements then being juxtaposed to obtain the desired thickness. A first reinforcement comprises a first sheet, for example of carbon fiber or glass fiber, linked to a second sheet by passing a weft or warp thread from the first sheet into the second, for example of aramid fiber in the case of this layer 33.

FIG. 6 illustrates a possible type of link between the two reinforcements. A first reinforcement 61 is seen from above. Weft or warp threads 62 from the other reinforcement, situated below, cross the meshes of this first reinforcement 61 to fix the two reinforcements together. The weave of the reinforcements is, for example, produced by a fine mesh.

In particular, this third layer 33 takes up the residual deformation of the second layer 32, dissipates the shockwave. It notably adds withstand strength with the continuity of the material, by dissipation of the mechanical stresses in the whole rear face.

The third layer 33 has, for example, a thickness of the order of half the thickness of the second layer 32.

The thicknesses of the layers are adapted to the required protection level. Protection layers 34, 35 are, for example, fixed on each side of the assembly formed by the three layers 31, 32, 33. A conductive film or a suitable paint can be applied to these layers.

FIG. 7 illustrates a known method of producing a piece made of composite material obtained by resin-transfer molding. The three layers 31, 32, 33 are molded with resin, in a single piece, to form a single-piece composite material. More particularly, all the layers are wetted at the same time by the resin. They are not glued together.

The set of the three layers is made up of superimposed fabrics 71, 72, 73. Each layer is characterized by its fabric type. The number of layers of fabric of each layer 31, 32, 33 depends on the level or the type of protection sought, as indicated hereinabove. These layers are stacked at the bottom of a mold 70, represented in cross-section, the internal shape of which corresponds to the shape that is to be given to the protection device. A very large number of shapes is thus possible.

The top of the mold is closed by a cover 74, in fact a sheet of semi-permeable plastic. Seals 75 arranged between the sheet and the mold make it possible to ensure a tight seal and thus correctly close the mold.

In a first phase, the collections of dry fabrics 71, 72, 73 are therefore stacked at the bottom of the mold, then the latter is closed by the sheet 74. Then, a vacuum pump 77 is activated. This is linked by a pipe 78 to the interior of the mold. This pipe 78 opens out at a point situated at the level of the fabric layers, substantially opposite to that where the resin inlet 76 opens out. In the next phase, by operating the stop valve 79, liquid resin is sent inside the mold via a suitable pipe 76 placed so that the resin penetrates all the layers. A grid situated at the level of the pipe 78 of the vacuum pump arrests the flow of resin.

Advantageously, occasional excess thicknesses of fabrics can be produced in certain places to produce reinforcements or to contain inserts.

The resin used can be epoxy resin or phenolic resin. The latter type of resin has the notable advantage of being a very good thermal insulator, which improves the fire resistance.

In the overall budget of the weight of a device according to an embodiment of the invention, the proportion of resin, forming the matrix, can, for example, be of the order of 30% and the proportion of fabrics can be of the order of 70%.

Such a structure makes it possible to obtain a very significant weight saving while ensuring a very good mechanical withstand strength as has been demonstrated by the tests performed by the Applicant.

The invention claimed is:

1. A protection device against ballistic projectiles, comprising:

a first layer of synthetic fabric formed resin-transfer molding;

a second layer of synthetic fabric formed by resin-transfer molding, adjacent to the first layer, the second layer comprising glass fibers crossed with carbon fibers; and a third layer of synthetic fabric formed by resin-transfer molding, adjacent to the second layer on a side of the second layer that is opposite from the first layer, wherein the first layer, the second layer, and the third layer together form a reinforced protection device.

2. The device as claimed in claim 1, wherein the second layer includes a three-dimensional reinforcement weave, comprising:

a plurality of reinforced two-dimensional weaves mirror-symmetrically arranged in a stack, each reinforced two-dimensional weave including a plurality of glass fibers oriented in a first direction and a plurality of carbon fibers oriented in a second direction; and a bond in the stack of reinforced two-dimensional weaves to provide cohesion in a third direction.

3. The device as claimed in claim 2, wherein the first direction and the second direction cross at an angle of less than approximately 90°.

4. The device as claimed in claim 3, wherein the first direction and the second direction cross at an angle of between approximately 30° and approximately 60°.

5. The device as claimed in claim 2, wherein the bond includes a weft, the weft comprising carbon fibers or glass fibers.

6. The device as claimed in claim 2, wherein the bond comprises glue.

7. The device as claimed in claim 1, wherein:

the first layer is oriented towards the ballistic projectiles; and the fabric of the first layer comprises aramid fibers.

8. The device as claimed in claim 1, wherein:

the first layer is oriented towards the ballistic projectiles; and the fabric of the first layer comprises fibers woven in two dimensions, in two directions forming between them an angle of less than or equal to approximately 90°.

9. The device as claimed in claim 8, wherein the angle is between approximately 30° and approximately 60°.

10. The device as claimed in claim 1, wherein the third layer comprises a plurality of fabric reinforcements linked in pairs by a weave in a third dimension to provide cohesion in the third direction.

11. The device as claimed in claim 10, wherein a set of two reinforcements linked in pairs comprises a first reinforcement of carbon or glass fibers linked to a second reinforcement of aramid fibers.

12. The device as claimed in claim 1, wherein the fabric of the third layer comprises a finer mesh than the fabric of the first layer and the second layer.

13. The device as claimed in claim 1, wherein each layer comprises a stack of fabric layers, the stack comprising a number of fabric layers depending on a predetermined thickness and a stopping power of the ballistic projectile.

14. The device as claimed in claim 1, wherein the thickness of the third layer is half the thickness of the second layer.

15. The device as claimed in claim 1, wherein the resin is a phenolic resin.

16. The device as claimed in claim 1, wherein a proportion of resin is approximately 30% and a proportion of fabrics is approximately 70%.

* * * * *